US005822902A

United States Patent [19]

Alvern

[11] Patent Number: 5,822,902

[45] Date of Patent: Oct. 20, 1998

[54] DEVICE FOR DISPLAYING INFORMATION ON A FUEL PUMP FILLER GUN

[75] Inventor: Stein Alvern, Oslo, Norway

[73] Assignee: Alvern Norway A/S, Norway

[21] Appl. No.: 684,197

[22] Filed: Jul. 19, 1996

[51] Int. Cl.[6] ..... B67D 5/00

[52] U.S. Cl. ..... 40/584; 40/610; 222/23; 222/192; 116/DIG. 8; 116/270

[58] Field of Search ..... 40/584, 609, 610; 141/392, 287, 368; 222/23, 192; 116/DIG. 8, 270

[56] References Cited

U.S. PATENT DOCUMENTS

| | | | |
|---|---|---|---|
| D. 173,006 | 9/1954 | Anderson . | |
| D. 173,007 | 9/1954 | Anderson . | |
| D. 279,483 | 7/1985 | Goldman . | |
| D. 279,484 | 7/1985 | Goldman . | |
| D. 366,310 | 1/1996 | Fell . | |
| 4,044,711 | 8/1977 | Jamison | 116/DIG. 8 |
| 4,408,791 | 10/1983 | Griffin et al. . | |
| 4,465,209 | 8/1984 | Wilder . | |
| 4,595,121 | 6/1986 | Schultz | 116/DIG. 8 |
| 4,690,182 | 9/1987 | Knaus . | |
| 5,058,637 | 10/1991 | Fell . | |
| 5,184,309 | 2/1993 | Simpson et al. . | |
| 5,184,655 | 2/1993 | Fell . | |

FOREIGN PATENT DOCUMENTS

| | | |
|---|---|---|
| AU-S-122642 | 2/1995 | Australia . |
| AU-S-123343 | 5/1995 | Australia . |
| 0407271A1 | 1/1991 | European Pat. Off. . |
| 62-208396 | 9/1987 | Japan . |
| 850627 | 10/1992 | Japan . |
| 1393062 | 5/1975 | United Kingdom . |
| 2147273 | 5/1985 | United Kingdom . |
| WO 90/08375 | 7/1990 | WIPO . |

*Primary Examiner*—Cassandra H. Davis
*Attorney, Agent, or Firm*—Finnegan, Henderson, Farabow, Garrett & Dunner, L.L.P.

[57] ABSTRACT

Display apparatus connected to a filler gun of a fuel dispensing station. A carrying body on a prominent part of the filler gun supports a detachable display surface carrier which in turn supports an inflatable balloon shaped element. The balloon shaped element carries an advertising message which is viewable when the balloon shaped element is inflated. A valve on the filler gun is connected to a source of inflation air and to the balloon shaped element. The valve is actuated by the fuel dispensing trigger on the filler gun. During fueling an inflation gas is supplied to the balloon shaped element which in the inflated state prominently displays the advertising message.

13 Claims, 5 Drawing Sheets

19
10
28
29
16
33
36
32
35
34
30
31

DEVICE FOR DISPLAYING INFORMATION ON A FUEL PUMP FILLER GUN

RELATED APPLICATIONS

This application is related to the following pending U.S. Patent Applications: U.S. Ser. No. 08/284,427, filed Aug. 3, 1994; U.S. Ser. No. 08/590,407, Filed Jan. 25, 1996; and U.S. Ser. No. 08/610,961, filed Mar. 5, 1996.

FIELD OF THE INVENTION

Apparatus which is connected to the filler gun of a fuel pump for displaying an advertisement message during a fueling operation.

BACKGROUND OF INVENTION

The vending of gasoline has become in recent years a self-service operation for customers. Each driver who enters a gasoline station typically pumps his or her own gas. Self-service gasoline vending operations have also evolved into miniature convenience stores, where customers may shop for other household items such as beverages and basic needs. The sale of such household items has increased significantly to the point where they constitute a significant position of the business of these fueling stations. The purchase of other non-automotive merchandise at the fueling stations has been encouraged using various sales and merchandising techniques.

The gasoline stations not only include large banners advertising the availability of non-automotive merchandise, but some of the LCD displays provided on the fuel dispensing machines provide messages alerting consumers to the availability of non-automotive products. In accordance with the foregoing related patent application(s), advertising has been implemented on the filler gun, so that a consumer while pumping fuel into his automobile is made aware of merchandise which is available from the fueling station.

Various discount sales of merchandise are run by these establishments, such that on different days or different weeks of the month, different products are offered for sale. By placing updated advertising notices in the vicinity of the fueling nozzle, it is possible to alert the consumer to such sales and otherwise increase the total sales of such products to these consumers. The marketing practices of these facilities requires frequent changes of the advertising to accommodate the different product mix and sales activity at different times.

SUMMARY OF THE INVENTION

The present invention is directed to a device for providing advertising media on a filler gun of a fueling station. The invention provides for an inflatable display element connected to the filler gun in a prominently visible location. The inflatable display element may be inflated when the user pumps gasoline by depressing the filler gun trigger. Once inflated, the advertising message on the inflatable element is readily visible to the user during the fueling operation.

Once the customer has completed the fueling operation, the trigger is released and the inflatable element may resume its normal deflated condition until such time as the pump is again used by the filling station's customers.

In accordance with a preferred embodiment of the invention, a source of compressed air may be supplied to a valve means located on each filler gun to supply inflation pressure to the inflatable element. The inflatable element is fastened to a carrying body supported on the filler gun. The carrying body can be removed, and a new carrying body connected having an inflatable display element with a different message to advertise different goods and services available at the facility.

DESCRIPTION OF THE PREFERRED EMBODIMENT

Figure 1:
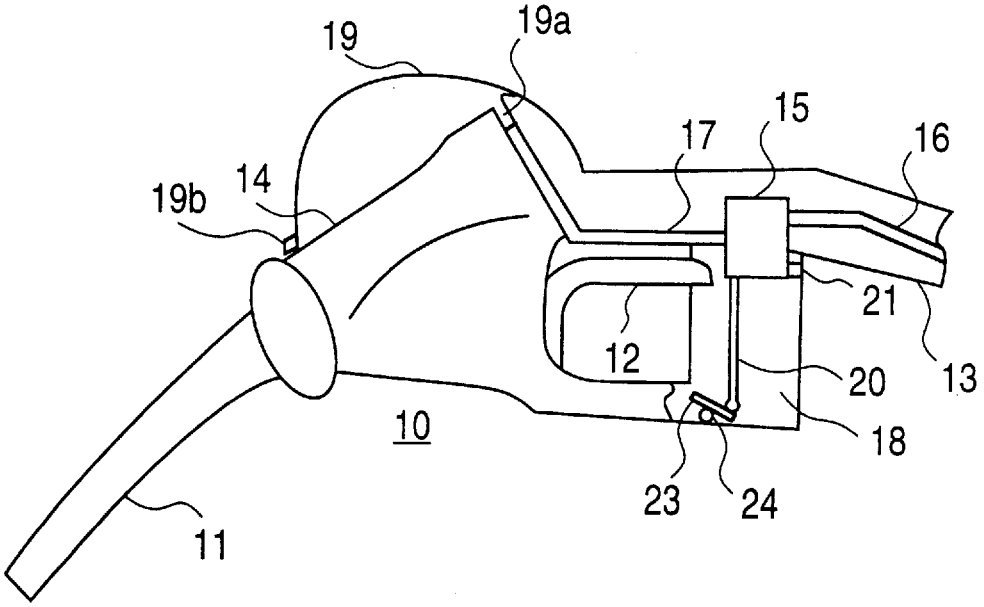
FIG. 1 illustrates a filler gun having an inflatable element which bears an advertising message.
Figure 2:
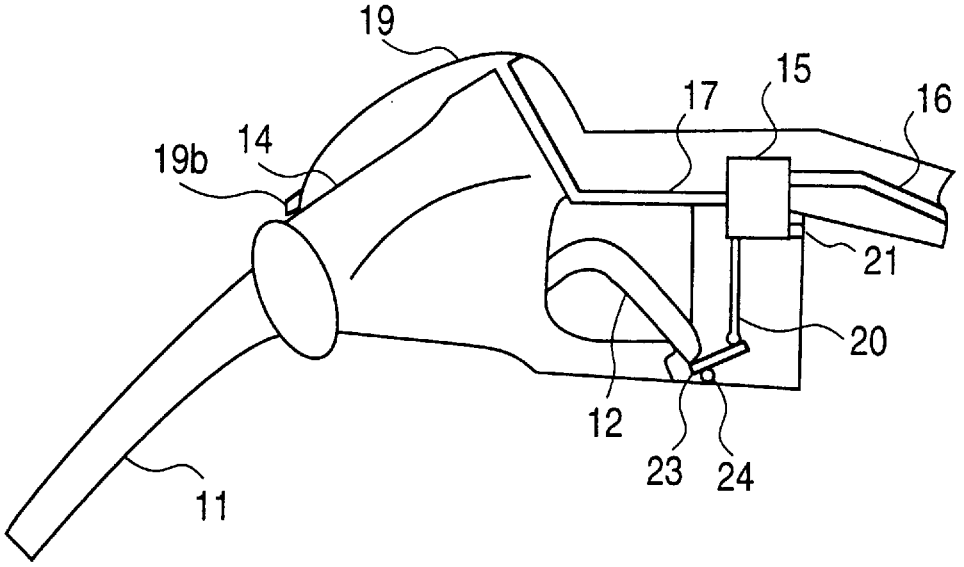
FIG. 2 illustrates the filler gun of FIG. 1 during the inactive condition prior to dispensing fuel.

Referring now to FIGS. 1 and 2, there is shown a filler gun 10 having a nozzle 11 for dispensing fuel. The filler gun 10 has a trigger 12 which is grasped during the fueling operation and brought to the position shown in FIG. 1. Fuel is dispensed from a reservoir in the filling station through the fuel hose 13 to nozzle 11.

Also illustrated in connection with the filler gun of FIGS. 1 and 2 is an inflatable balloon-shaped element 19 which is connected to a detachable carrying body 14 on the filler gun. The inflatable balloon-shaped element includes thereon advertising indicia which is viewable to the customer while dispensing fuel during the fueling operation. Prior to fueling, and when fueling is completed, the inflatable balloon-shaped element 19 takes the deflated configuration of FIG. 2, and is not particularly noticeable.

The inflation and deflation of the balloon-shaped element 19 occurs by virtue of a valve 15 connected to the balloon-shaped element 19 via an air passageway provided by channel 17. The balloon-shaped element 19 includes an extending nipple 19(*a*) which is received within the channel 17. The base of the inflatable balloon-shaped element 19 is held with conventional fastening means to the carrying body 14.

A pressure release valve 19(*b*) maybe provided on the balloon-shaped element 19 to prevent over pressurizing the balloon-shaped element 19 and ultimately rupturing the balloon-shaped element 19.

In operation, a valve 15 connected to a supply of compressed air through inlet conduit 16, supplies compressed air to the channel 17 for inflating the balloon-shaped element 19. An actuator arm 20 of the valve is operably connected to a pivot arm 23, supported about pivot point 24. During the inactive state, prior to a fueling operation, the trigger 12 rests its end on the edge of the pivot arm 23. This forces the actuating arm 20 of valve 15 to its upwardmost position, blocking air from entering the channel 17, while simultaneously permitting any air within the balloon-shaped element 19 to be vented through a vent 21.

During the fueling operation, as the trigger 12 is raised, the valve actuator arm 20 assumes its most extended position, which blocks the vent 21 while providing communication between inlet conduit 16 and channel 17 for inflating the balloon-shaped element 19.

Figure 3:
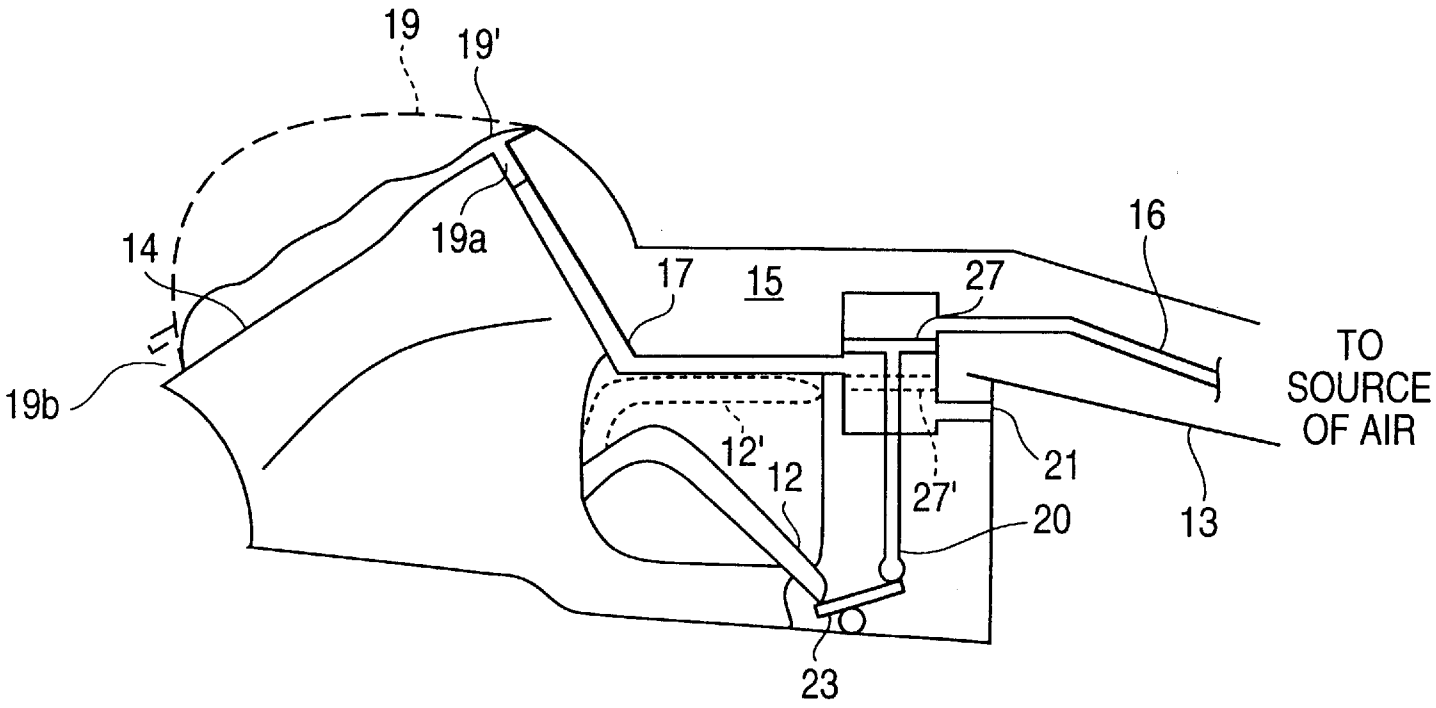
FIG. 3 is an enlarged view of the pneumatic circuit used to inflate and deflate the inflatable element on the filler gun.

Referring in particular to FIG. 3, the structure of the valve 15 can be seen in greater detail. The valve 15 includes a plunger 27, which in the position shown in FIG. 3 blocks air from flowing from inlet conduit 16 into the outlet channel 17. As the trigger 12 is moved to its active position 12' for fueling, the actuator arm 20 is forced downward by air pressure from inlet conduit 16 until plunger 27 reaches the position 27' representing the maximum extension of actuating arm 20. In this position, the air from the inlet conduit 16 is permitted to pass into the outlet 17 for inflating the balloon-shaped element 19, while blocking the vent 21 from the outlet channel 17.

At the completion of fueling, the trigger member 12 returns to the position shown in FIG. 3, and plunger 27 returns to the position of blocking air from inlet conduit 16. In this position, the outlet channel 17 is in communication with vent 21, permitting deflation of the balloon-shaped element 19. The inflatable material for element 19 is selected to have an elasticity which provides the minimum height 19 in its deflated condition.

Figure 4:
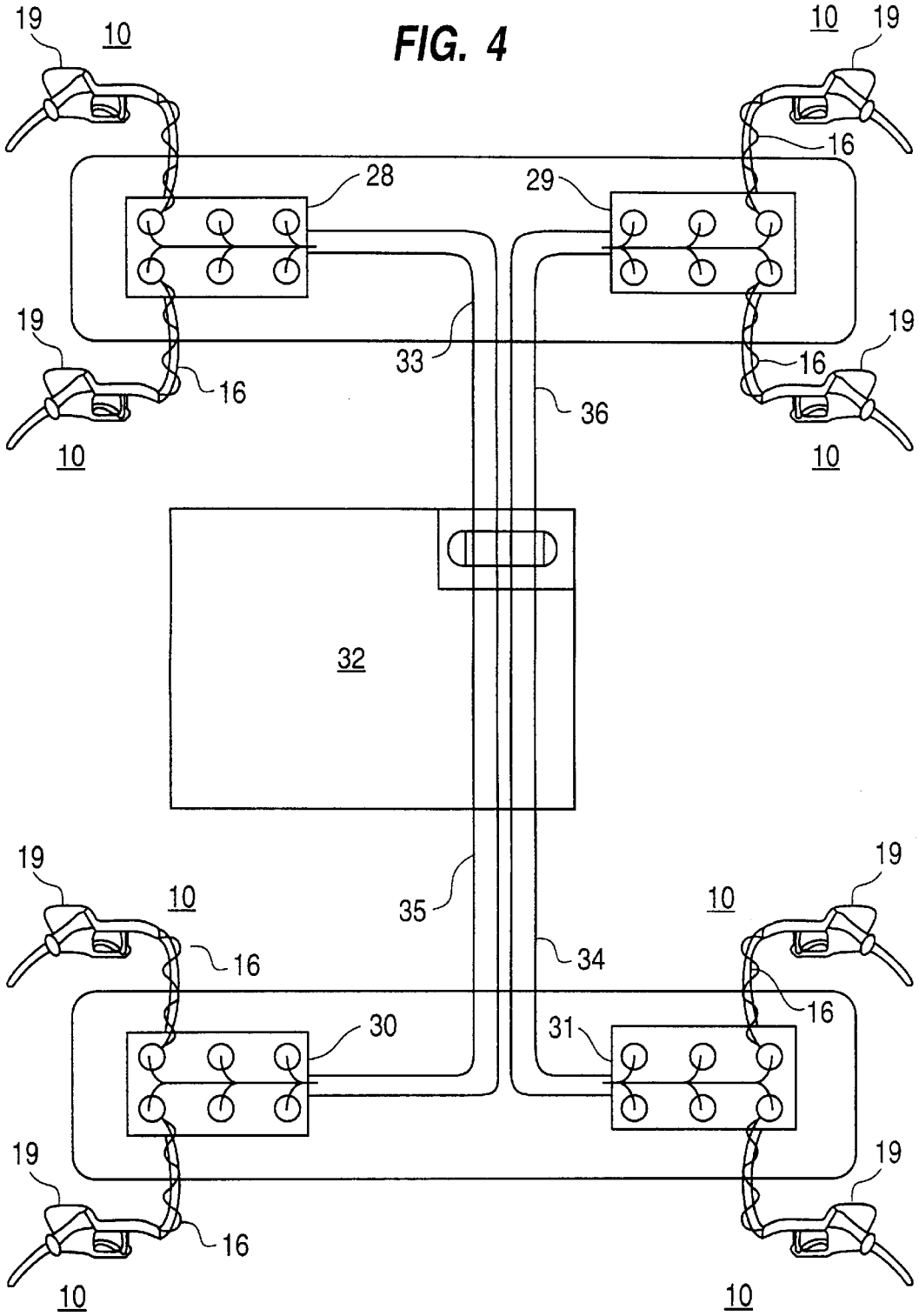
FIG. 4 illustrates the service station layout having a manifold for supplying compressed air to each of the filler guns.

FIG. 4 illustrates a typical fueling establishment which would employ filler guns 10 having the foregoing new display apparatus associated therewith. The display apparatus is connected via each inlet conduit 16 to a plurality of air manifolds 28, 29, 30 and 31. Each of the manifolds 28–31 is connected to a respective air supply hoses 33 and 34 and 35 and 36, which are in turn connected to a compressor station 32 centrally located between the fueling islands.

Figure 5:
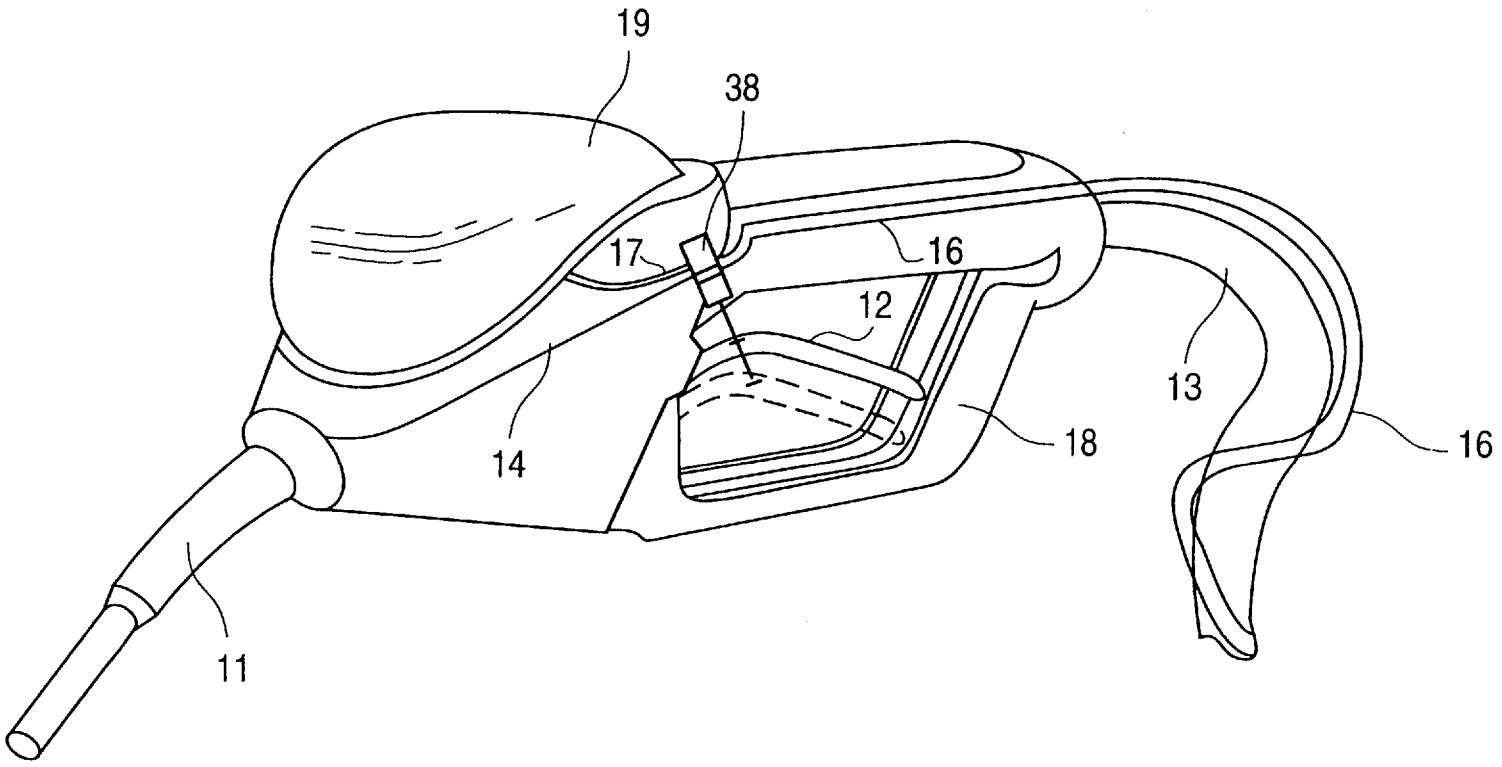
FIG. 5 is an overall view of another embodiment of the invention which provides for an inflatable balloon element having advertising media contained thereon.

FIG. 5 illustrates yet another embodiment of the invention wherein a different valve structure 38 is shown, operated by the trigger 12 on the filler gun 10. The trigger 12's distal end thereof rides within the channel of the filler gun trigger guard 18, and operably engages the actuator of valve 38, to permit the supplying of compressed air via valve 38 to the inflatable balloon-shaped element 19, as well as to permit venting of the same when the trigger is released.

The connection of the inflatable balloon-shaped element 19 to the removable display surface carrier 14 may be by conventional fastening means, to permit removal of the balloon-shaped element 19 so that the advertising messages may be frequently changed.

Figure 6:
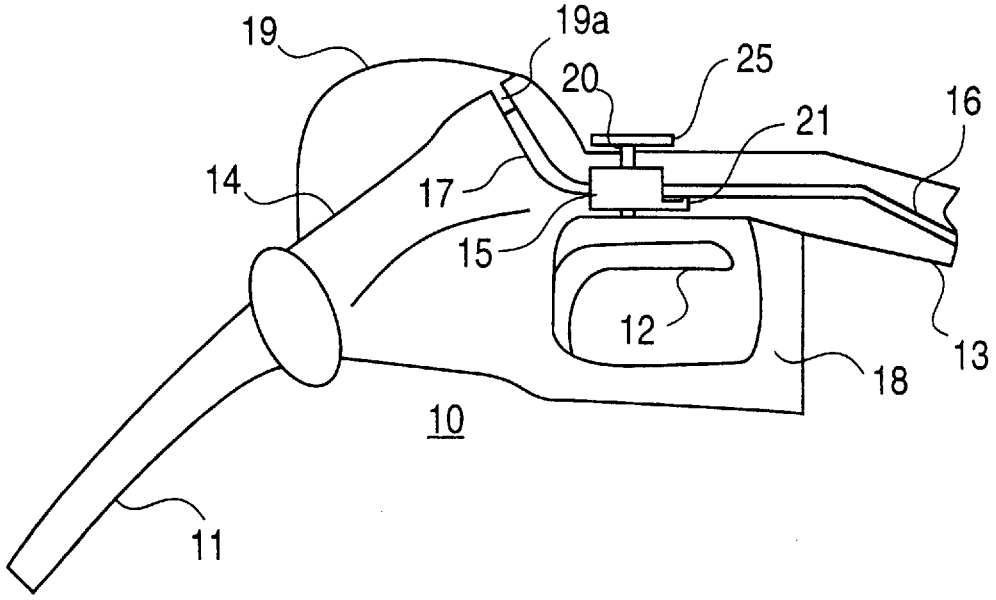
FIG. 6 is an overall view of another embodiment of the invention which inflates the inflatable balloon element when the nozzle is removed from its holder.

FIG. 6 illustrates yet another embodiment of the invention which includes an inflation valve 15 which is operated by removing the filler gun from its stationary holder. Before fueling the filler gun 10 is stored in a substantially vertical position. The actuator plate 25 maintains the actuator arm 20 in the depressed condition. When the filler gun 10 is removed from the holder, the air from inlet conduit 16 forces the actuator arm 20 outward which results in the air inlet 16 communicating with the air outlet channel 17. The balloon-shaped element 19 is therefore inflated. Following the fueling operation, the filler gun is returned to its storage position depressing the actuator arm 20. The depressed actuator arm 20 vents the balloon element through vent 21 while closing off the air inlet 16.

Figure 7:
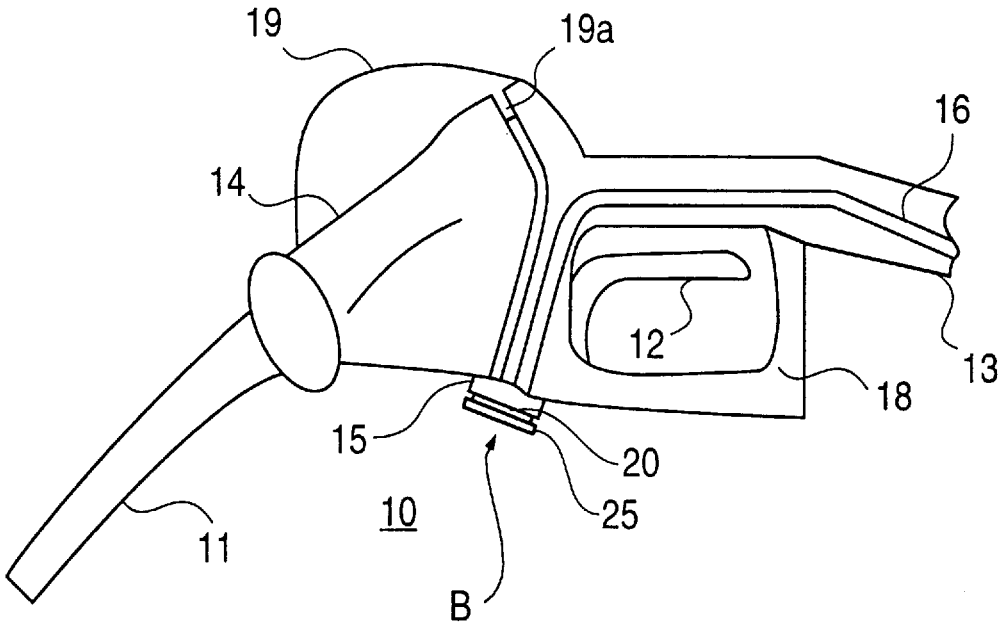
FIG. 7 is an overall view of another embodiment of the invention which inflates the balloon element with a control element located on the pump handle.

FIG. 7 illustrates yet another embodiment of the invention which provides for actuation of the inflation valve 15 by the user. The valve actuator plate 25 is positioned where it may be depressed by the user's index finger to operate the valve 15 to control inflation of the balloon-shaped element 14.

Thus, there has been described with respect to multiple embodiments of the invention a new device for attaching to a filler gun to display advertising media for users of such a device. While the embodiment has been described with respect to a central air compressor, connecting each of the filler guns, those skilled in the art will recognize yet other embodiments which may be practiced in accordance with the invention. For instance, self-contained compressed inert gas cartridges may be implemented within the filler gun in accordance with the teachings of the present invention, to provide the mechanism for inflating and deflating the balloon element bearing the advertising indicia.

What is claimed is:

1. Apparatus for use in a vehicle service station comprising:

a filler gun connected to a fluid source; and a filler gun trigger controlling flow of fluid through the filler gun;

an inflatable balloon displaying information and removably attached to said filler gun;

a channel in the filler gun connecting an air source and the inflatable balloon; and an actuator valve in the channel for regulating air flow to the inflatable balloon in response to operation of the filler gun trigger.

2. The apparatus of claim 1 further comprising means for inflating said inflatable balloon by movement of said filler gun trigger to a dispensing position and deflating the inflatable balloon by movement of the filler gun trigger to a non-dispensing position.

3. The apparatus according to claim 1 wherein said inflatable balloon mounts on a carrying body, the carrying body being removably attached to said filler gun.

4. Apparatus for use in a vehicle service station comprising:

a filler gun connected to a source of fluid;

an inflatable balloon supported on said filler gun bearing an advertising message, said inflatable balloon being removable from said gun to permit changes to said advertising message; and means for deflating said inflatable balloon and a means for inflating the balloon.

5. The apparatus according to claim 4 wherein said means for deflating said inflatable balloon is operated by said filler gun.

6. Display apparatus removably attachable to a filler gun of a fluid pump of a kind used in vehicle service stations, said filler gun having a trigger for controlling the flow of fluid from a fluid source, said display apparatus comprising:

a carrying body removably attachable to the filler gun and having an upper surface defining an elongate display surface, an inflatable balloon-shaped element detachably mounted on said carrying body and bearing information visible when inflated, and means responsive to actuation of the trigger to a fluid flow position for simultaneously inflating said balloon-shaped element, and for deflating said balloon-shaped element upon the return of the trigger to a normal fuel flow cut-off position.

7. A filler gun for a fluid pump of a kind used in vehicle service stations, the filler gun having a trigger to control the flow of fluid, the combination comprising:

a removable inflatable balloon-shaped display apparatus bearing thereon an information display, said display apparatus secured to said filler gun at a location such that said information display is visible upon inflation of said balloon-shaped display, and means for inflating said display apparatus concurrently with the flow of fluid from the filler gun.

8. A filler gun for a fluid pump of a kind used in vehicle service stations, the filler gun having a trigger to control the flow of fluid, the combination comprising:

a removable inflatable balloon-shaped display apparatus bearing thereon an information display, said display apparatus secured to said filler gun at a location such that said information display is visible upon inflation of said balloon-shaped display apparatus, and means for inflating said display apparatus concurrently with the flow of fluid from the filler gun, wherein said inflating means inflates said display apparatus only when said trigger is actuated to pump fluid.

9. A filler gun for a fluid pump of a kind used in vehicle service stations, the filler gun having a trigger to control the flow of fluid, the combination comprising:

a removable inflatable balloon-shaped display apparatus bearing thereon an information display, said display apparatus secured to said filler gun at a location such that said information dislplay is visible upon inflation of said balloon-shaped display apparatus, and means for inflating said display apparatus concurrently with the flow of fluid from the filler gun, wherein the restoration of said trigger to a normal fuel non-dispensing position causes the deflation of said balloon-shaped display apparatus.

10. Apparatus for use in an automotive gasoline refueling station comprising:

a filler gun connected to a source of fuel over a fuel line and to a source of pressurized air over an air line, a hand-actuable filler gun trigger for selectively controlling the flow of fuel from said fuel source, an inflatable balloon bearing an advertising message, said balloon being removably attachable to said filler gun at a location permitting easy viewing of the advertising message on said balloon when inflated, and means controlled by said filler gun trigger for inflating said balloon when said filler gun trigger is operated to its fuel dispensing position and for deflating said balloon when said filler gun trigger is operated to its non-dispensing fuel position.

11. An apparatus for use in a vehicle service station comprising:

a filler gun connected to a fluid source;

an inflatable balloon displaying information and removably attached to the filler gun;

a channel in the filler gun connecting an air source, which is separate from the fluid source, and the inflatable balloon; and an actuator valve in the channel for regulating air flow to the inflatable balloon by movement of the filler gun from a holder.

12. The apparatus according to claim 11 further comprising means for inflating the inflatable balloon by removing said filler gun from the holder and for deflating the inflatable balloon by returning the filler gun to the holder.

13. An apparatus for use in a vehicle service station comprising:

a filler gun connected to a fuel source;

an inflatable balloon displaying information and removably attached to the filler gun;

a channel in the filler gun connecting an air source, which is separate from the fuel source, and the inflatable balloon; and an actuator valve in the channel for regulating air flow to the inflatable balloon the actuator valve including a valve actuator plate extending from the filler gun for operating the actuator valve.

* * * * *